US011497327B2

(12) United States Patent
Miller

(10) Patent No.: US 11,497,327 B2
(45) Date of Patent: Nov. 15, 2022

(54) DISPLAY SUPPORT

(71) Applicant: RM Holdings, L.L.C., North Liberty, IA (US)

(72) Inventor: Roger H Miller, North Liberty, IA (US)

(73) Assignee: RM Holdings, L.L.C., North Liberty, IA (US)

( * ) Notice: Subject to any disclaimer, the term of this patent is extended or adjusted under 35 U.S.C. 154(b) by 0 days.

(21) Appl. No.: 17/682,573

(22) Filed: Feb. 28, 2022

(65) Prior Publication Data

US 2022/0175158 A1 Jun. 9, 2022

Related U.S. Application Data

(63) Continuation of application No. 17/242,786, filed on Apr. 28, 2021, now Pat. No. 11,278,133.

(60) Provisional application No. 63/026,342, filed on May 18, 2020.

(51) Int. Cl.
*A47G 1/14* (2006.01)

(52) U.S. Cl.
CPC ..... *A47G 1/143* (2013.01)

(58) Field of Classification Search
CPC ..... A47G 1/143
See application file for complete search history.

(56) References Cited

U.S. PATENT DOCUMENTS 253,457 A 2/1882 Wiederer
1,822,398 A * 9/1931 Haines ..... A47G 1/142 248/464
2,954,630 A * 10/1960 Hull ..... A47G 1/143 40/761
4,704,814 A * 11/1987 Astolfi ..... A47G 1/142 40/761
5,730,413 A 3/1998 Chen
5,832,646 A 11/1998 Albin et al.
5,950,815 A * 9/1999 Yetman-Bellows ... A47G 1/143 211/85.2

(Continued)

FOREIGN PATENT DOCUMENTS

CA 515376 A 8/1955
GB 191228737 A 12/1913

(Continued)

OTHER PUBLICATIONS 117108.007GB—United Kingdom Application No. GB2596407—Examination and Search Report dated Oct. 26, 2021.

*Primary Examiner* — Gary C Hoge
(74) *Attorney, Agent, or Firm* — Simmons Perrine Moyer Bergman PLC

(57) ABSTRACT

The present invention is a display support comprising a bracket that is attachable to a display and having at least one wing adjacent to a bracket channel. The bracket channel has at least two keyways. An optional sleeve is held within the channel and has keyways aligned with the keyways of the bracket channel to form aligned keyways. A support arm, held within the bracket channel, has a key that can be received in one of the keyways. Rotation of the support arm in the bracket channel is prevented when the key is received in one of the keyways and rotation of the support is permitted when the key is not received in one of the keyways.

11 Claims, 5 Drawing Sheets

(56) References Cited

U.S. PATENT DOCUMENTS

| | | | | |
|---|---|---|---|---|
| 6,282,827 | B1 * | 9/2001 | Holmes | A47G 1/142<br>40/748 |
| 8,520,371 | B2 | 8/2013 | Peng et al. | |
| 2007/0089344 | A1 | 4/2007 | Ting | |
| 2008/0028657 | A1 | 2/2008 | Holmes | |
| 2014/0151524 | A1 | 6/2014 | Katterheinrich | |
| 2019/0133346 | A1 | 5/2019 | Cohen et al. | |

FOREIGN PATENT DOCUMENTS

| | | | |
|---|---|---|---|
| JP | 2008203362 | A | 9/2008 |
| KR | 20120001592 | A | 1/2012 |
| KR | 101502732 | B1 | 3/2015 |

* cited by examiner

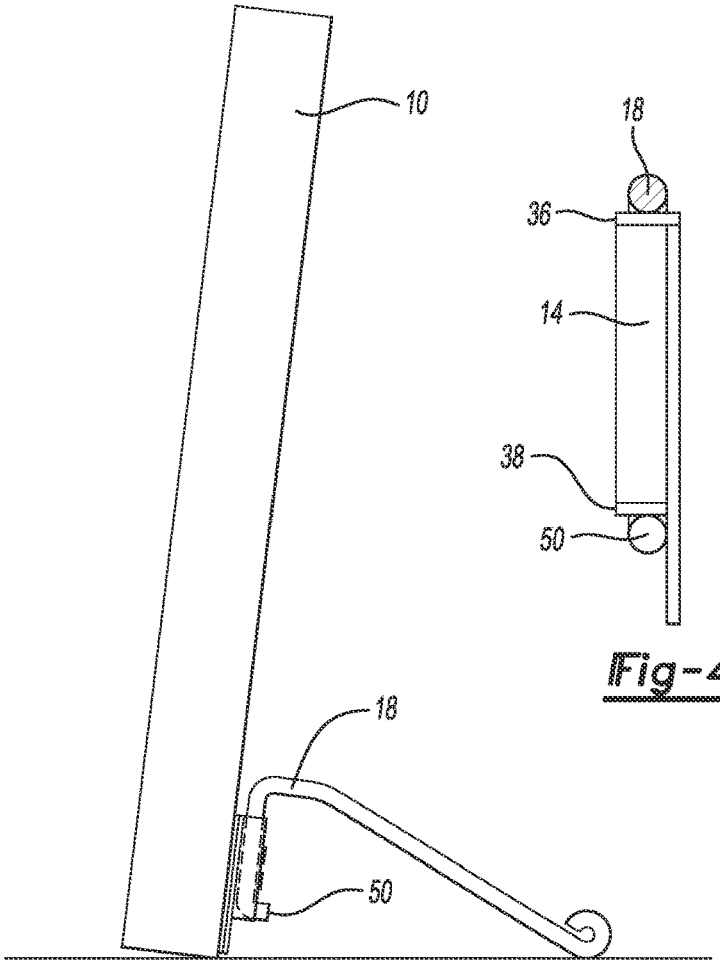
Fig-3
Fig-4
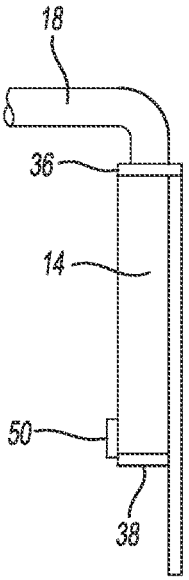
Fig-5
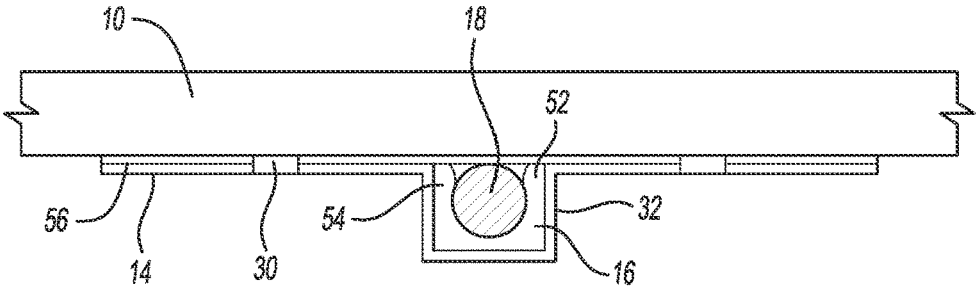
Fig-6A
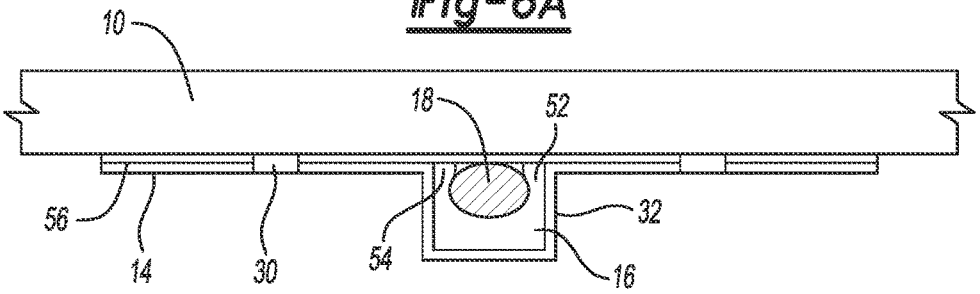
Fig-6B

DISPLAY SUPPORT

CLAIM OF PRIORITY

The present application is a continuation of the U.S. non-provisional application Ser. No. 17/242,786, filed on Apr. 28, 2021, which application claims the benefit of U.S. provisional application 63/026,342, filed on May 18, 2020, which are incorporated by reference.

FIELD OF THE INVENTION

The field of the invention is a device and method for supporting a display on a horizontal surface.

BACKGROUND OF THE INVENTION

Pictures in frames and other displays on horizontal surfaces are notoriously weak and unstable. Traditionally, a cardboard arm on the back of a frame is used to prop up the frame. However, such cardboard arms tend to be relatively weak and cannot support larger or heavier frames. Such arms are also unstable and can collapse without much force. A better solution is needed.

SUMMARY OF THE INVENTION

The present invention is a display support comprising a bracket that is attachable to a display and having at least one wing adjacent to a bracket channel. The bracket channel has at least one keyway. A sleeve is held within the channel and has a keyway aligned with the keyway of the bracket channel to form an aligned keyway. A support arm, held within the sleeve, has a key that can be received in the aligned keyway. Rotation of the support arm in the sleeve is prevented when the key is received in the aligned keyway and rotation of the support is permitted when the key is not received in the aligned keyway.

BRIEF DESCRIPTION OF THE DRAWINGS

FIG. 3 shows a side view of an installed display support with the support arm in the open or operable position supporting a picture on a surface, with the bracket portion of the support shown in phantom.

FIG. 4 shows a close up, cut away, side of view of the bracket, sleeve, and support arm in the closed position.

FIG. 5 shows a close up, cut away, side view of the bracket, sleeve, and support arm in the open position.

FIG. 6A shows a close up, cut away, top view of the bracket, sleeve, and support arm with a circular cross-section in the bracket portion of the support arm.

FIG. 6B shows a close up, cut away, top view of the bracket, sleeve, and support arm with an oval cross-section in the bracket portion of the support arm.

DETAILED DESCRIPTION

The display supports of the present invention provide stable and strong support for displays of a variety of shapes and sizes, such as picture frames and displays cases. Typically used for displays that are top heavy or otherwise do not stand upright on their own, display supports also allow the display to be canted relative to the surface on which they sit. This allows the viewer to better view the item displayed. It also improves the stability of the display.

Figure 1:
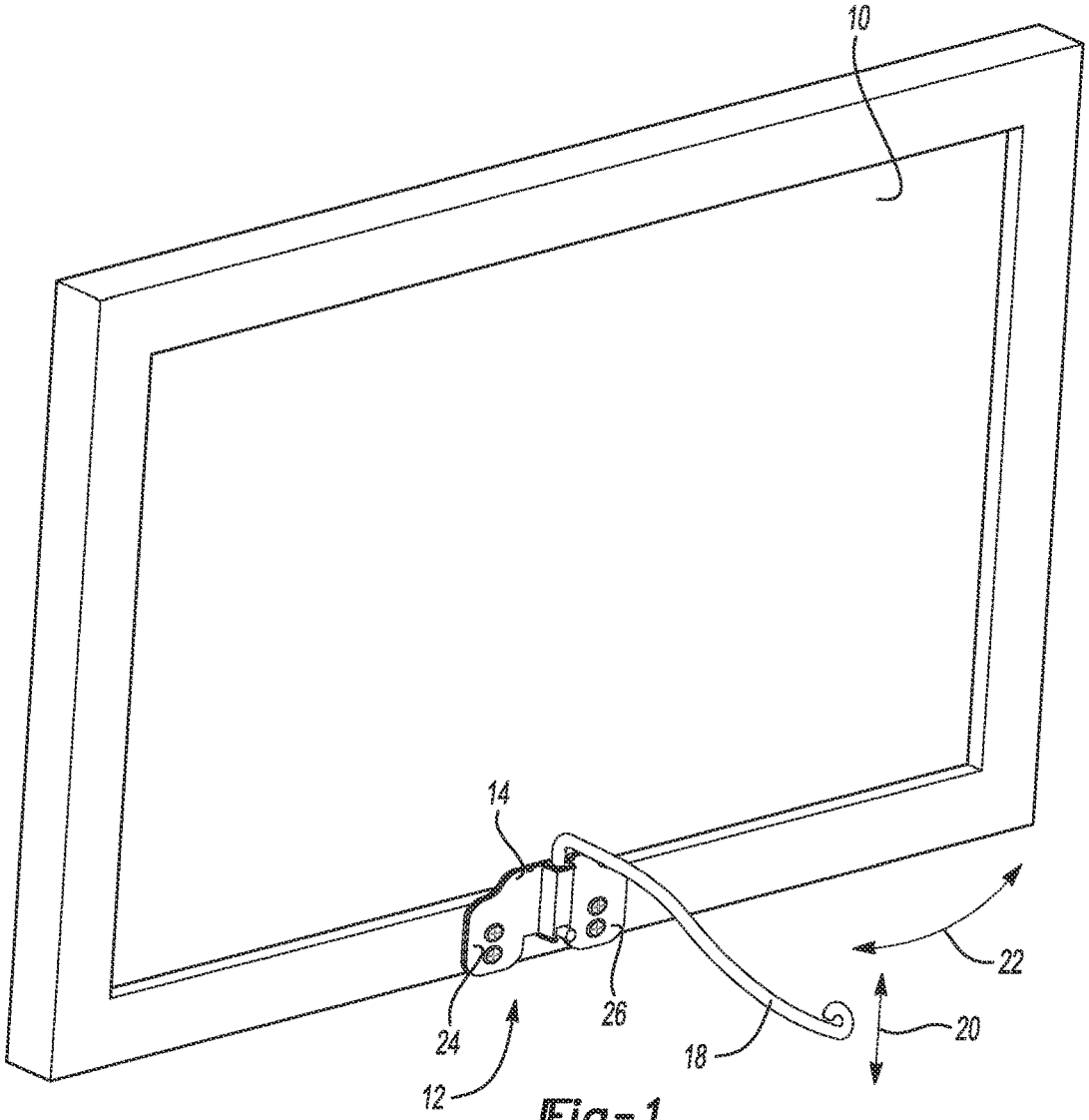
FIG. 1 shows a rear oblique view of an installed display support with the support arm in the open or operable position.
Figure 2:
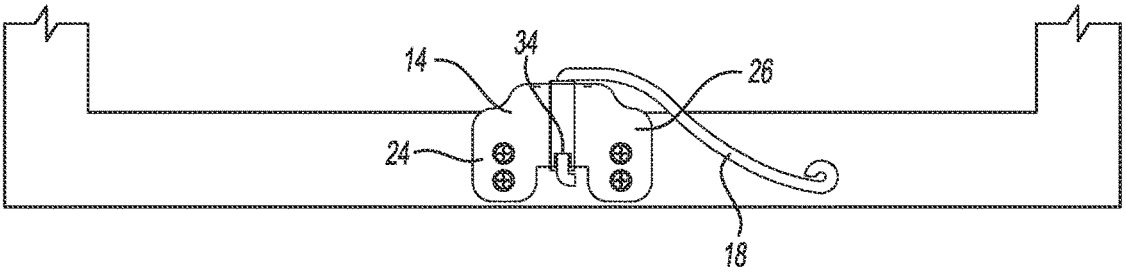
FIG. 2 shows a rear view of an installed display support with the support arm in the closed or storage position.

As seen in the Figures, the display 10 has a display support 10 attached to it, and the display support 12 comprises at least one bracket 14, at least one sleeve 16, and at least one support arm 18. In FIG. 1, the support arm is in the open or operable position and the support arm rests on the surface to support the display. In the open position, the support arm is generally perpendicular to the display. Arrow 20 indicates that the support arm 18 is movable up and down relative to the bracket 14 and sleeve 16. Arrow 22 indicates that the support arm 18 is rotatable within the sleeve 16 between the open and closed position. In FIG. 2, the support 18 arm is the closed or storage position with the support arm 18 adjacent to the display 10, thus facilitating storage of the display. In the closed position, the support arm 16 is generally parallel to the display. FIG. 3 shows the display 10 on a surface with the support arm 18 in the open position. FIG. 4 shows a close up, side view of the bracket 14 with the support arm 18 in the closed position. FIG. 5 shows a close up, side view of the bracket 14 with the support arm 18 in the open and locked position.

To move the support arm from the closed position to the open position, the support arm is rotated within the sleeve about the axis of the channel or its length. Once in the open position, the support may be locked into position by inserting the key (in the depicted embodiment, the key end) into the keyway of the sleeve. Typically this is done by pulling up on the support arm to slide the support arm in the sleeve and thus bringing the key end into the keyway.

The bracket 14 has at least one wing and preferably two wings 24, 26. The at least one wing is used to attach the bracket to the display and is generally planar in form. The at least one wing acts to spread the weight of the display across a surface area of the wing(s) and bracket, and to otherwise provide support to display through its connection to the support arm.

The bracket, when installed, is attached at the wing(s) to the display, either mechanically or adhesively. For example, fasteners 28 such as nails, screws, or snap-fit fasteners may be used to attach the bracket 14 to the display 10, such as through through-holes 30 in the bracket, as seen at FIGS. 1, 2 and 7.

Figure 7:
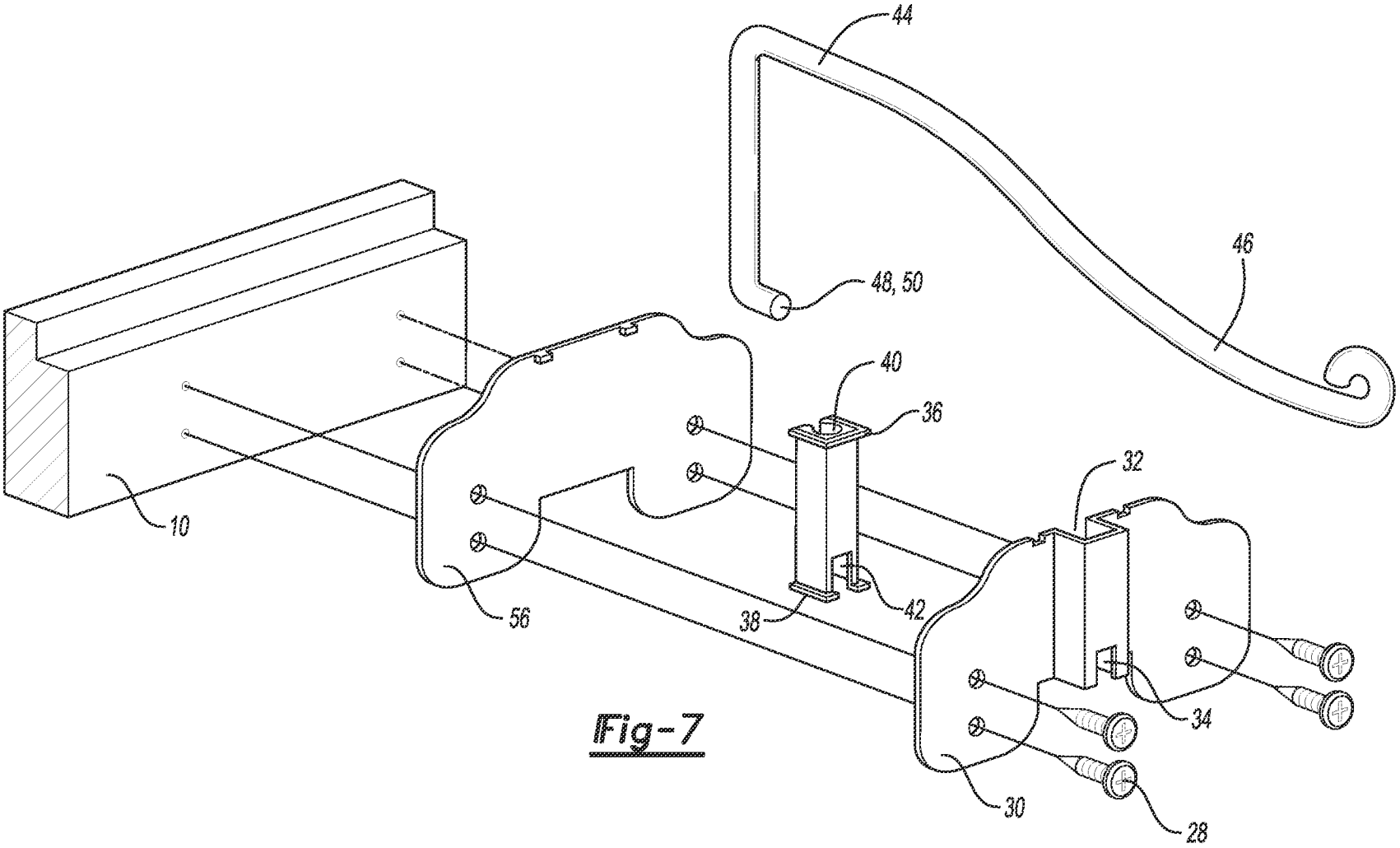
FIG. 7 shows an exploded view of the components of one embodiment of the display support.

The bracket includes a bracket channel 32 (as seen in FIG. 7) located next to the at least one wing or between the two wings in the embodiment depicted in the Figures. The bracket channel is generally vertically oriented with respect to the wing(s) of the bracket; that is, generally perpendicularly to the horizontal surface upon which the display will rest. The bracket channel generally runs from the top of the bracket to the bottom of the bracket. The bracket channel can have any cross-section, with a square or rectangle cross-section being preferred, as seen in FIG. 6.

The bracket includes a keyway 34 or notch in the bracket channel in which a portion of the material making up the channel is removed. The keyway may simply be the absence of material from that portion of the bracket. In the Figures, the keyway is shown near the bottom of the bracket or bracket channel, although other placement of the keyway is also contemplated.

Preferably, the bracket is made out of a unitary piece of material, such as metal or plastic. The material of the bracket is typically sheet-like; that is, relatively thin compared to the area covered by the bracket. The length and width of the bracket is selected to provide sufficient area for attachment or support to the display. The depth of the bracket is generally defined by the depth of the bracket channel.

The sleeve 16 is held within the bracket channel 32, preferably as a unitary piece that is held in a press fit or friction fit manner, although adhesive or other attachment devices may be used as well. The sleeve 16 may include a top lip 36 (as seen in FIGS. 4, 5, and 7) that rests on, contacts, or is adjacent to a top edge of the bracket at the channel. The sleeve may also include a bottom lip 38 (as seen in FIGS. 4, 5, and 7) that contacts or is adjacent to the bottom edge of the bracket at the channel. The lips may be continuous (e.g. a unitary lip) or discontinuous (e.g. like several teeth) in nature. Such lips help locate the sleeve within the bracket channel and assist in retaining the sleeve in the bracket channel.

Like the bracket, the sleeve has a channel that runs the length of the sleeve. Also, like the bracket channel, the sleeve channel 40 may include a keyway 42 or notch. The bracket keyway 34 and the sleeve keyway 42 generally align with each other such that both keyways can receive the key of the support arm, as discussed below. In a preferred embodiment, the aligned keyways are at or near the bottom of the bracket channel and sleeve, such that the aligned keyways are near the surface upon which the display may be rested. In another embodiment, the aligned keyways are at or near the top of the bracket channel and sleeve, such that the length of the bracket channel and sleeve are between the aligned keyways and the surface upon which the display may be rested.

The support arm 18 generally has a circular cross-section (as seen in FIG. 6A) or an oval cross-section (as seen in FIG. 6B) to facilitate rotation of the support arm within the sleeve channel. It is contemplated that the support arm may have polygonal cross-sections or a gear cross-section. Such cross-sections would allow rotation of the support arm upon the application of some force, but otherwise resist or prevent rotation of the support arm. It is contemplated that the cross-section may vary along the length of the support arm. The support arm is preferably made out of a unitary piece of material such as metal or plastic with sufficient stiffness to support a wide variety of weights of displays.

Figure 8A:
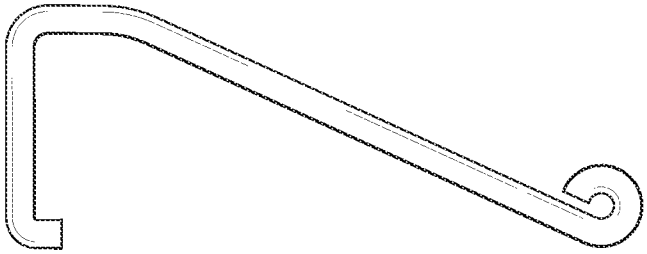
FIGS. 8A-8D show several support arms with varying shapes and configurations.
Figure 8B:
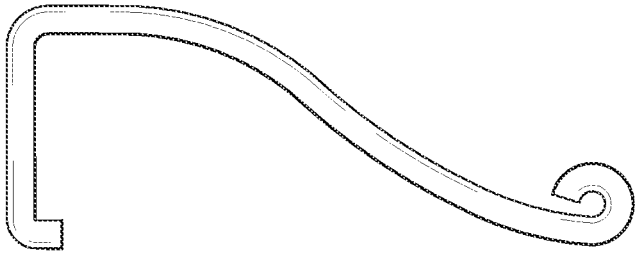
Figure 8C:
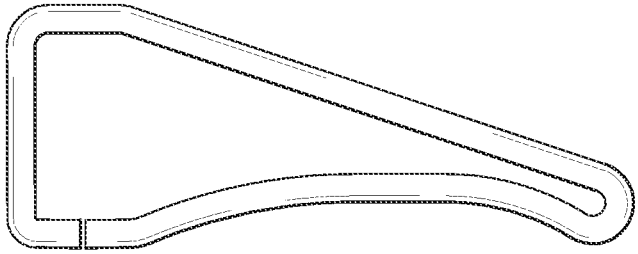
Figure 8D:
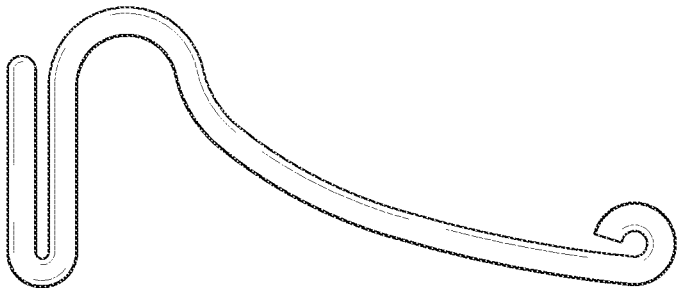

The support arm includes two portions; a bracket portion 44 and a surface portion 46. The bracket portion 44 is nearer the bracket and the surface portion 46 is nearer where the support arm contacts or rests on the surface, with no specific dividing line between the portions being required. The bracket portion 44 is adapted to interact with the bracket and/or sleeve, such as being held within the bracket channel or sleeve channel and the keyway of each of the bracket or sleeve. The surface portion 46 provides a location for the support arm to contact or rest on a surface, preferably without damaging the surface. The overall shape and length of the support arm are selected to provide the display with an aesthetically pleasing cant when the support arm is in the open position or operable position. Also, the overall shape and length are selected with improving overall stability of the display. The support may be a loop, including a closed loop, of material such as seen at FIG. 8C, or a length of material as seen in FIGS. 1-3, 7, 8A, 8B, and 8D.

The bracket portion 44 preferably includes a key 48 that is of a shape or size that differs from the rest of the bracket portion of the support arm. When the key is located at the end of the bracket portion of the support arm, it may be referred to as a key end 50. In one embodiment, the key 48 is turned to create an angle with the portion of the support arm held within the channel or sleeve. For example, a key end 50 may be at a 90° angle to the support held within the channel or sleeve. Preferably, the key end points toward the surface portion of the support arm.

The support arm 18 is generally slidable within the sleeve 16 to move the support arm between a locked and unlocked position. The locked position is when the key 48 of the support arm is in the keyway of the bracket and sleeve, and the support arm is held in place relative to the bracket and display. In the locked position, the support arm will not rotate about an axis parallel to the sleeve/channel. The unlocked position is when the key of the support arm is not in the keyway, and the support will rotate about the axis parallel to the sleeve/channel.

When the support arm is in the open and locked position, and the display is resting on a surface, the weight of the display will provide additional pressure on the bracket/sleeve and thus the support arm in order to help prevent the support arm from sliding out of the locked position. This is because the display is slightly tilted or canted from vertical when resting on a surface.

The sleeve may be made of a material, such as metal or preferably plastic, that is pliable and also with a relatively high coefficient of friction, both of which improve that grip of the sleeve on the support arm. Preferably the sleeve and the bracket are of different materials, with bracket materials selected for strength and stiffness and the sleeve material selected for pliability and its coefficient of friction.

The sleeve channel 40 has a cross-section that is partially circular with at least one and preferably several opposing teeth 52, 54 on either side of the opening of the channel, as seen in FIG. 6. Several teeth may extend along the length of the sleeve to form a row of teeth down one side of the sleeve or a single tooth may extend the length of the sleeve. The distance between the opposing teeth (See FIG. 6) is such that it is less than the diameter of the bracket portion 44 of the support arm 18, such that the support arm is press fit into the sleeve and sleeve channel. In this manner, the teeth of the sleeve help to hold the support arm in position by impinging on the support arm, whether the support arm is in the open or closed position. This works whether the bracket portion of the support arm is circular or oval.

When the bracket portion of the support arm has an oval cross-section (as shown in FIG. 6A), it has the added feature of creating additional impingement on the support arm by the sleeve. If the long axis of the oval is parallel to the length of the support arm, then the support arm will impinge more on the sleeve in closed position. If the long axis of the oval is perpendicular to the length of the support arm, then the support arm impinges more on the sleeve in the open position. This will result in the support arm being held more tightly in the given position.

Also, the oval cross-section may be used to resist rotation of the support arm in the sleeve, thus creating additional locking of the support into position. For example, where the long axis of the oval is parallel to the length of the support arm, the support arm may resist rotation, and become seated, when it is in the open position. Thus, creating a snap-to-lock situation where the support arm no longer rotates freely when it is in the open position. This would assist the key and keyway combination in creating the open and locked position of the support arm.

Similarly, where the long axis of the oval is perpendicular to the length of the support arm, the support arm may resist rotation, and become seated, when it is in the closed position. Thus, creating a snap-to-lock situation where the support arm no longer rotates freely when it is in the closed position. This would create a closed and locked position for the support arm. In this embodiment, the short axis of the oval cross-section of the support would be parallel to the length of the support arm and would result in reduced pressure by the sleeve on the support arm, thus making the support arm easier to slide within the sleeve. This would facilitate easier movement of the support arm between the open-locked (e.g. the key in the keyway) and open-unlocked (e.g. the key not in the keyway) positions.

In another embodiment, the bracket portion of the support arm includes a discontinuity along its length that increases the effective diameter of the bracket portion of the support. The increased effective diameter may be in all directions (thus creating a circular cross-section with a larger diameter) or in just one direction (thus creating an oval cross-section). In the later embodiment, the discontinuity may act in the same manner as the oval cross-section of the support arm. For example, where the long axis of the discontinuity is parallel to the length of the support arm, the support arm may resist rotation, and become seated, when it is in the open position. Thus, creating a snap-to-lock situation where the support arm no longer rotates freely when it is in the open position. This would assist the key and keyway combination in creating the open and locked position of the support arm.

Figure 9:
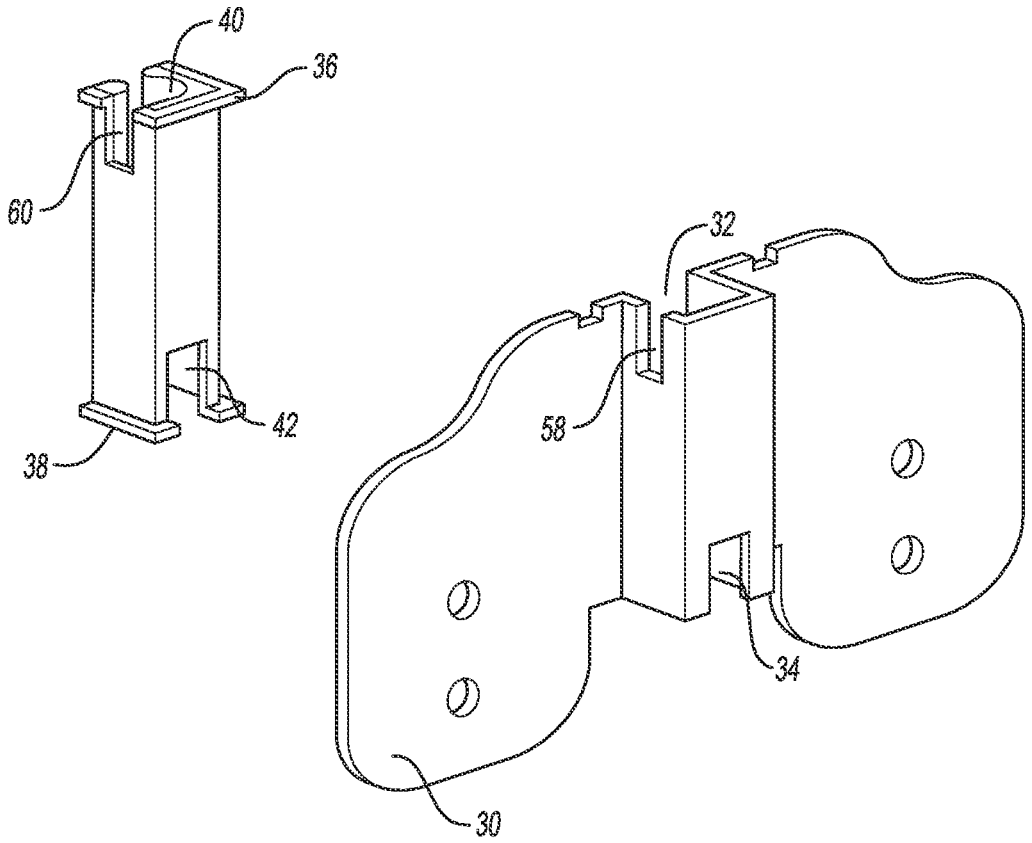
FIG. 9 shows an exploded view of an embodiment with a bracket and sleeve having two keyways.

In another embodiment, the channels of the bracket and the sleeve have an alternate or additional keyway located such that the support arm can be placed in a closed and locked position by pulling up on the support when the support arm is adjacent (e.g. parallel) to the display. Moreover, while the keyway is preferably located at or near the bottom of the bracket (e.g. relatively closer to the surface upon which the display is to rest), the keyway(s) may be located at or near the top of the bracket. In this embodiment, a relatively middle portion of the support arm is received in the keyway of the bracket channel and sleeve and thus acts as the key. Here, a bend in the support arm may accomplish the function of preventing the support arm from rotating when the support arm is in the keyway. Here, the support arm is pushed, dropped, or seated in the keyway, as opposed to pulling up on the support arm in order to seat the key in the keyway for other embodiments. A looped embodiment of the support arm (as seen in FIG. 8C) may be used in this embodiment of the keyway located relatively closer to the top of the bracket. As seen in FIG. 9, in one embodiment, the bracket 14 and sleeve 16 contain first aligned keyways 34, 42 and second aligned keyways 58, 60, respectively. The second aligned keyways are located near the top of the bracket channel and sleeve.

To improve the strength and stability of the display support, a back plate 56 may be used in addition to the bracket and would be used between the bracket and the display. The bracket may attach to the back plate. In the alternative, the back plate may include through holes aligned with the through holes of the bracket. The back plate may be separately attached to the display through adhesive or fasteners or may be held in place by the attachment of the bracket to the display with fasteners in the through holes. The back plate may include keys corresponding to keyways on the bracket (or vice versa) to help locate the back plate and bracket for placement on the display.

In another embodiment, a plurality of support arms are utilized with a single bracket or with a plurality of brackets. For a plurality of support arms with a single bracket, a single or a plurality of channels in the bracket may be utilized. For a single channel and a plurality of support arms, a single or a plurality of sleeves may be utilized. With a plurality of support arms, a plurality of aligned keyways are preferred, with a keyway for each support arm preferred.

It will be further appreciated that functions or structures of a plurality of components or steps may be combined into a single component or step, or the functions or structures of one-step or component may be split among plural steps or components. The present invention contemplates all of these combinations. Unless stated otherwise, dimensions and geometries of the various structures depicted herein are not intended to be restrictive of the invention, and other dimensions or geometries are possible. Plural structural components or steps can be provided by a single integrated structure or step. Alternatively, a single integrated structure or step might be divided into separate plural components or steps. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention. The present invention also encompasses intermediate and end products resulting from the practice of the methods herein. The use of "comprising" or "including" also contemplates embodiments that "consist essentially of" or "consist of" the recited feature.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes.

LIST OF REFERENCE NUMERALS

| | |
|---|---|
| 10 | Display |
| 12 | Display Support |
| 14 | Bracket |
| 16 | Sleeve |
| 18 | Support Arm |
| 20 | Arrow |
| 22 | Arrow |
| 24 | Wing |
| 26 | Wing |
| 28 | Fastener |
| 30 | Through hole |
| 32 | Bracket channel |
| 34 | Bracket keyway |
| 36 | Top lip |
| 38 | Bottom lip |

-continued

| | |
|---|---|
| 40 | Sleeve Channel |
| 42 | Sleeve Keyway |
| 44 | Bracket portion |
| 46 | Surface portion |
| 48 | Key |
| 50 | Key end |
| 52, 54 | Opposing teeth |
| 56 | Back plate |
| 58 | Second bracket keyway |
| 60 | Second sleeve keyway |

What is claimed is:

1. A support comprising:

a bracket attachable to an object to be supported on a horizontal surface and having at least one wing adjacent to at least one bracket channel, wherein the bracket channel has at least two keyways, a support arm is held within the bracket channel and has a bracket portion and a surface portion, wherein the bracket portion has a key that can be received in each of the at least two keyways, wherein rotation of the support arm is prevented when the key is received in one of the at least two keyways and rotation of the support is permitted when the key is not received in either of the at least two keyways.

2. The support of claim 1 further comprising a sleeve located within the at least one bracket channel, wherein the sleeve is held within the channel and has at least two keyways each aligned with one of the at least two keyways of the bracket channel to form at least two aligned keyways.

3. The support of claim 2 wherein at least one aligned keyway is located near a bottom of the bracket channel or sleeve.

4. The support of claim 3 wherein the key is a key end of the support arm.

5. The support of claim 3 wherein the sleeve comprises a channel having a partially circular cross-section.

6. The support of claim 5 wherein the bracket portion of the support arm has a circular cross-section.

7. The support of claim 5 wherein the bracket portion of the support arm has an oval cross-section.

8. The support of claim 1 wherein the support arm is perpendicular to the bracket when the key is received in one of the at least two keyways.

9. The support of claim 1 wherein the support arm is parallel to the bracket when the key is received in one of the at least two keyways.

10. The support of claim 2 wherein at least one aligned keyway is located near a top of the bracket channel or sleeve.

11. The support of claim 2 wherein a first aligned keyway is located near the bottom of the bracket channel or sleeve and a second aligned keyway is located near the top of the bracket channel or sleeve.

* * * * *